United States Patent [19]

deVries

[11] 3,965,698

[45] June 29, 1976

[54] REFRIGERATED STRUCTURE

[75] Inventor: Egbert deVries, Kettering, Ohio

[73] Assignee: Quad Corporation, Highland Park, Ill.

[22] Filed: Apr. 1, 1975

[21] Appl. No.: 563,981

[52] U.S. Cl. ..... 62/454; 62/DIG. 13
[51] Int. Cl.[2] ..... F25D 19/00
[58] Field of Search ..... 62/89, 454, DIG. 13

[56] References Cited

UNITED STATES PATENTS

| | | | |
|---|---|---|---|
| 1,947,223 | 2/1934 | Ophuls | 62/89 |
| 2,016,608 | 10/1935 | McDowell et al. | 62/DIG. 13 |
| 2,364,220 | 12/1944 | Johnson | 62/DIG. 13 |
| 2,744,388 | 5/1956 | Kleist | 62/454 |
| 2,758,390 | 8/1956 | Muntens | 62/DIG. 13 |

*Primary Examiner*—Lloyd L. King
*Attorney, Agent, or Firm*—Fidelman, Wolffe & Waldron

[57] ABSTRACT

A refrigerated chamber or building having an upper crawl space above the ceiling wherein the crawlspace is maintained under a negative pressure in order to provide an outflow of refrigerated air through the insulation into the crawlspace. This serves to prevent the inflow of warm air into the upper portions of the refrigeration chamber, which normally would have a negative pressure, with accompanying harmful moisture precipitation in the insulation.

2 Claims, 1 Drawing Figure

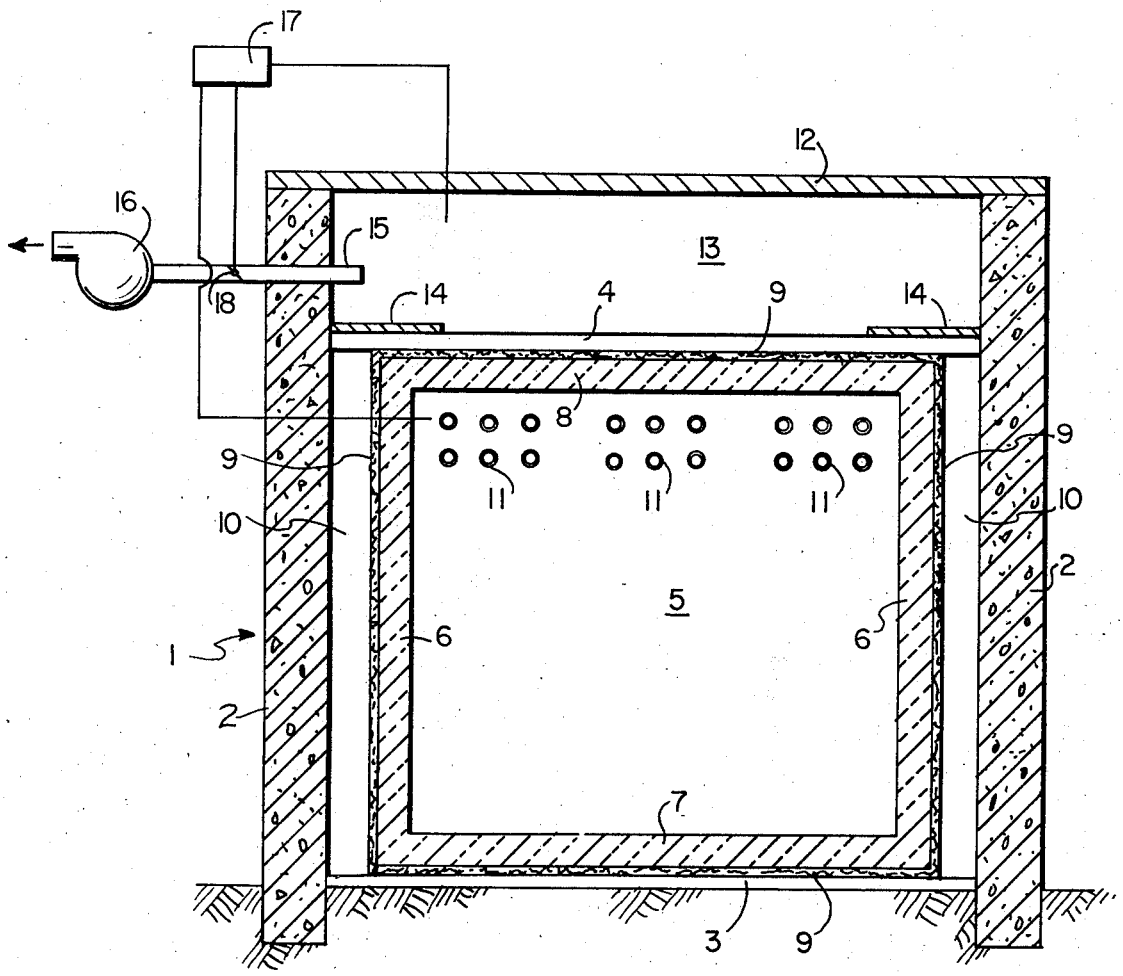
17
12
16
15
13
18
14
4
9
14
8
9
9
11
11
11
10
10
2
5
1
6
6
2
7
3
9

REFRIGERATED STRUCTURE

BACKGROUND OF THE INVENTION

1. Field of the Invention

This invention relates to refrigerated chambers or buildings and more particularly to means for preventing the inflow of warm outside air into the upper portion of the structure.

2. Description of the Prior Art

It has long been recognized that there is air movement through the insulated walls in refrigeration buildings when the outside temperature is greater than the inside temperature. This is due in a considerable degree to the increased density of the cold air which tends to sink to the floor, whereby the air pressure at the bottom is greater than outside pressure and the air pressure at the top, near the ceiling, is less than the external pressure. Thus, air tends to flow in through the walls and ceiling at the top and to flow out at the bottom. The inward flow of warm outside air is harmful in that moisture condenses within the walls and causes deterioration of the insulation and wall structure.

It has been proposed by Ophuls, U.S. Pat. No. 1,947,223, to avoid these problems by maintaining the pressure within a refrigerating building somewhat higher than the external pressure, whereby there would be an air flow of cold air outwardly through the walls. He also suggests a false wall around the entire insulating wall structure with a space therebetween and maintaining a subatmospheric pressure in the intermediate space. This solution involves extensive structural additions with attendent increase in cost, which my invention, which makes use of generally already existing structural features, avoids.

Summary

The invention consists in maintaining the pressure in the crawl space above the insulated ceiling of a refrigerated building at a pressure sufficiently low to insure an outward air flow from the upper region of the inner space of the refrigerated building.

BRIEF DESCRIPTION OF THE DRAWING

The FIGURE is schematic view in section of a refrigerated building according to the invention.

DESCRIPTION OF THE INVENTION

In the FIGURE a generally conventional cooler structure, identified by reference numeral 1, is depicted. This comprises outer walls 2, a floor slab 3, ceiling 4 and roof 12. Located within the space defined by the walls 2 is a refrigeration or freezer chamber 5 which is defined by walls 6 and floor 7 and ceiling 8, all of insulated construction in a manner well known to the art. Said insulated walls, floor and ceiling are covered on the outside surfaces by a vapor barrier 9 which may conveniently be sheet plastic such as polyethylene or any other vapor barrier known to the art. As shown in the FIGURE, insulated walls 6,6 are spaced a short distance from walls 2,2 to form an air space as shown at 10. Insulated floor 7 with its vapor barrier rests on slab 3 while insulated ceiling 8 and its vapor barrier abuts cooler ceiling 4. Within refrigeration chamber 5, conventional refrigerator coils 11 are connected to refrigeration equipment (not shown) to maintain the temperature at the desired figure. It will be understood that conventional refrigeration door means (not shown) are provided to permit entry into chamber 5.

Above ceiling 4 is a roof structure 12 which may be a flat as shown, gabled, or a shed roof. Between the roof 12 and the ceiling is a conventional open crawl space 13. The roof structure and adjacent outside walls are made substantially air tight to prevent air leakage. To seal off crawl space 13 from space 10, a sealing membrane 14, which may be sheet plastic or rubber or the like, is placed along the outer edges of ceiling 4, within crawl space 11. As shown in the FIGURE, the membrane extends from the inner surface of wall 2 to a distance of somewhat beyond the inner surface of insulated wall 6.

Connected to crawl space 13 via an inlet pipe 15 is an exhaust fan 16. This serves to maintain a subatmospheric pressure within the crawl space sufficient to cause air flow through vapor barrier 9 and insulated cooler ceiling 4. A barometric regulator 17 controlling a damper 18 within inlet pipe 15 regulates the pressure within the crawl space. One side of regulator 17 is connected to sense the pressure in the crawl space and the other side to sense the pressure at the top of the refrigerated chamber or building. The regulator and associated controls serve to keep the pressure difference at a predetermined amount.

The pressure difference between the outside and ceiling air pressures may be expressed mathematically as follows:

$$\Delta P = 7.55 \left( \frac{1}{460 + t_r} - \frac{1}{460 + t_0} \right) \times \frac{H}{2},$$

wherein $\Delta P$ = the pressure difference in inches of water between the outside and the ceiling air pressures;

$t_r$ = refrigerated temperature in °F;

$t_o$ = outside temperature in °F; and

H = ceiling height of building.

The negative pressure in the crawl space need only be slightly larger than the $\Delta P$ in order to overcome the tendency of the air to flow through the ceiling into the refrigeration chamber. So long as the slight negative pressure above the ceiling in the crawl space is sufficient to overcome the $\Delta P$ there will be no influx of moisture containing warm air through the vapor barrier into the insulation. By preventing this inflow, the insulation is maintained in a dry state. Should the insulation be wet or iced up, the outflow of cold air through the insulation will result in its drying out.

The above recitation describes the embodiment where the air flow takes place essentially through the insulated ceiling structure. If it is desired to have air flow through the walls in addition, as where it is desired to dry the insulation in one or more of walls 6, the sealing material 14 may be omitted as required or removed to the extent necessary if already in place. In this case the outer walls 2 have to be carefully caulked to seal off any cracks or openings through which air may be drawn in from the outside by the negative pressure caused by fan 16. The air pressure in the air space will be submospheric in at least the upper portion thereof and will vary according to the vacuum created by the suction fan and by the presence of any obstruction such as air stops in the air space.

What is claimed is:

1. In a refrigeration or freezer chamber having insulated walls, ceiling and floor including vapor barriers and located within a building having outer walls and a roof, a crawl space between the ceiling and the roof, the insulated walls spaced a relatively small distance from the outer walls to form an air space, and wherein air pressure in the chamber at the upper portion near the ceiling is less than atmospheric pressure; the improvement comprising an air exhaust means to maintain a subatmospheric pressure within the said crawl space and within at least the upper portion of said air space.

2. The refrigerated chamber or building of claim 1 wherein the air exhaust 1, include a barometric regulator to control the subatmospheric pressure and to keep it at a pre-determined amount.

* * * * *